United States Patent [19]

Hurt

[11] 4,348,815

[45] Sep. 14, 1982

[54] MULTI-PURPOSE SQUARE

[76] Inventor: Alfred A. Hurt, 116 Harvey Ave., Oak Hill, W. Va. 25901

[21] Appl. No.: 206,473

[22] Filed: Nov. 13, 1980

[51] Int. Cl.[3] ..... B43L 7/06

[52] U.S. Cl. ..... 33/419; 33/470; 33/473; 33/495

[58] Field of Search ..... 33/418, 419, 422, 424, 33/425, 451, 452, 460, 461, 464, 465, 468, 469, 470, 471, 473, 495–500

[56] References Cited

U.S. PATENT DOCUMENTS

| | | | |
|---|---|---|---|
| 304,196 | 8/1884 | Hill | 33/473 |
| 2,656,609 | 10/1953 | Siggson | 33/452 |
| 2,775,037 | 12/1956 | Baumunk | 33/499 |

*Primary Examiner*—Harry N. Haroian
*Attorney, Agent, or Firm*—Harvey B. Jacobson

[57] ABSTRACT

A pair of first and second elongated arms are provided and the arms include corresponding base and free ends. Pivot structure is provided and pivotally connects the base ends of the arms together for relative 360° angular displacement and the pivot structure and second arm include coacting structure whereby the axis of relative pivoting of the first and second arms may be adjustably shifted along the second arm. Also, the first and second arms include coacting latch structure whereby the arms, in at least one predetermined position of the pivot structure along the second arm, may be releasably secured in a plurality of relatively angularly displaced positions.

7 Claims, 7 Drawing Figures

10
12
14
16
18
20
22
23
25
32
36
42
44
48
50
52
53
54
56
58
60
62

MULTI-PURPOSE SQUARE

BACKGROUND OF THE INVENTION

Various forms of squares including relatively pivotal arm portions heretofore have been provided such as those squares disclosed in U.S. Pat. Nos. 973,437, 1,324,411, 1,646,958 and 1,663,821. In addition, various of these squares are provided with spirit levels and many include structure whereby the arms may be releasably secured in adjusted angularly displaced positions.

However, many of these previously known forms of squares are not constructed in a manner whereby the pivotally connected arms thereof may be relatively angularly displaced a full 360° and some do not include structure whereby the arms thereof may be releasably secured in numerous different relatively angularly displaced positions. Also, it is often desirable to indicate aligned line segments on opposite sides of a line intersecting the ray of the line segments and many previously known forms of squares are not capable of being used in this manner. Accordingly, a need exists for an improved form of square.

BRIEF DESCRIPTION OF THE INVENTION

The square of the instant invention is constructed in a manner whereby the arms thereof may be relatively angularly displaced a full 360°, whereby the arms thereof may be releasably secured in numerous predetermined relatively angularly displaced positions, and whereby the pivot axis pivoting connecting the arms may be adjustably shifted longitudinally along one of the arms.

The main object of this invention is to provide an improved square whose features enable usage of the square in different ways heretofore not possible with conventional pivoted arm squares.

Another object of this invention is to provide a pivoted arm square constructed in a manner whereby the relatively pivotal arms thereof may be releasably secured in a plurality of predetermined relatively angularly displaced positions.

Still another important object of this invention is to provide a pivoted arm square including arms thereof which may be relatively angularly displaced a full 360°.

A further object of this invention is to provide a pivoted arm square constructed in a manner whereby the pivot structure pivotally connecting the two arms may be longitudinally adjusted along one of the arms.

A still further object of this invention is to provide a pivoted arm square including structure whereby the arms of the square may be maintained in right angularly disposed positions throughout adjustment of the pivot connection between the arms longitudinally of one of the arms.

A final object of this invention to be specifically enumerated herein is to provide an improved pivoted arm square in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figures 1, 2, 3:
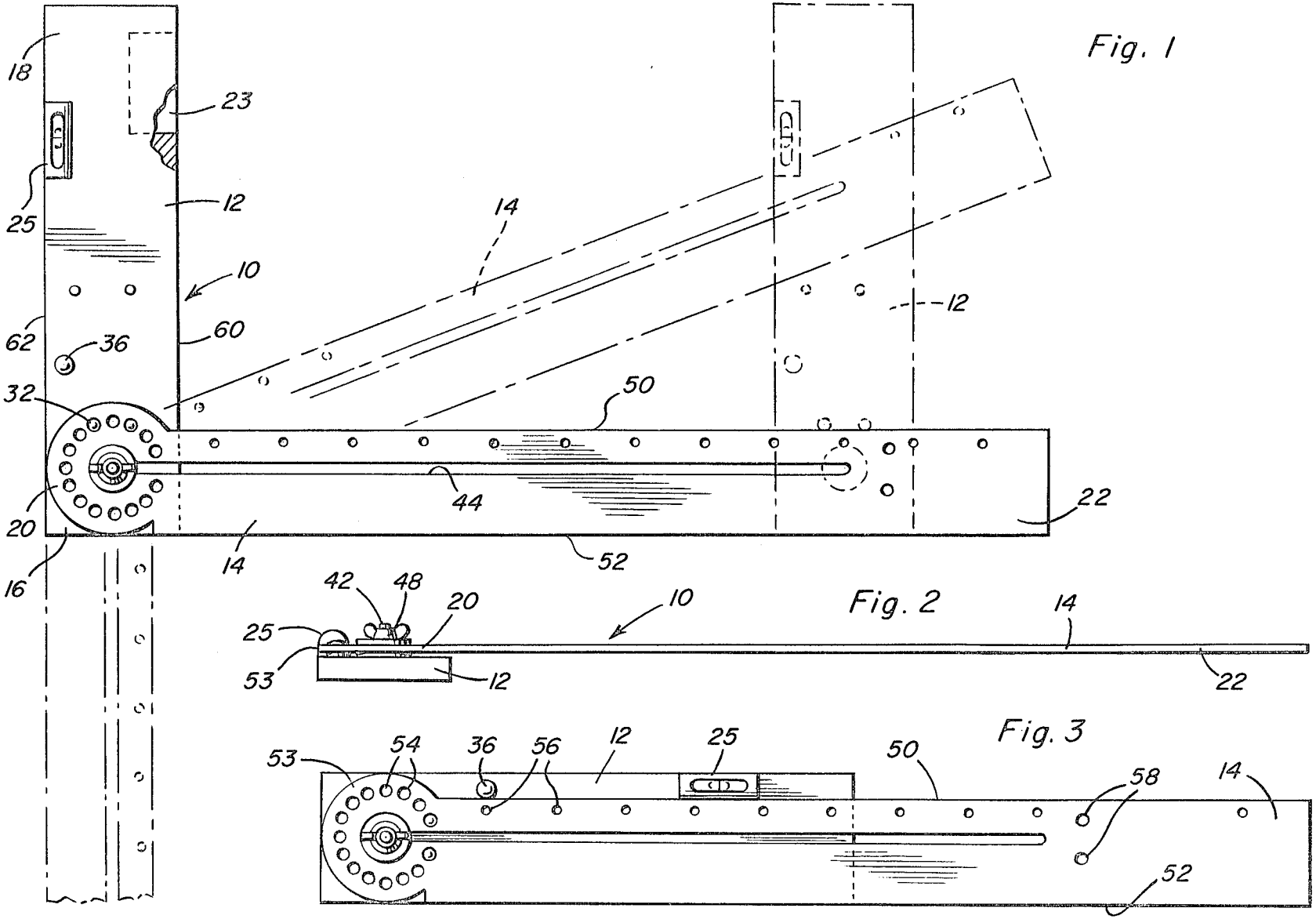
FIG. 1 is a plan view of a square constructed in accordance with the present invention and with the relatively pivotable arms thereof being illustrated in solid lines disposed generally normal to each other, an alternate relatively pivoted position of the arms being illustrated in phantom lines as well as an alternate position of the shorter arm spaced along the longer arm.
FIG. 2 is a side elevational view of the assemblage illustrated in FIG. 1.
FIG. 3 is a plan view of the assemblage illustrated in FIG. 1, but with the two arms of the square in parallel superposed relation.

Referring now more specifically to the drawings, the numeral 10 generally designates the square of the instant invention. The square 10 includes first and second short and long arms 12 and 14 and the short arm 12 includes base and free ends 16 and 18, while the long arm 14 includes base and free ends 20 and 22. The free end 18 of the arm 12 includes a magnet 23 embedded therein and also a spirit level 25 extending longitudinally of the arm 12. Further, the arm 12 includes a downwardly opening recess 24 formed therein closed by means of a closure panel 26 secured in position in any convenient manner. One end of a leaf spring type latch arm 28 is secured in secured in a corresponding end of the recess 24 by suitable fasteners 30 and the opposite end of the latch arm 28 includes a pair of upwardly projecting pins 32 which project through bores 34 formed in the base end 16 and opening downwardly into the recess 24. In addition, the longitudinal midportion of one longitudinal edge of the latch arm 28 includes an upwardly projecting button 36 which projects upwardly through a further bore 38 formed in the base end 16 and which also opens downwardly into the recess 24.

The base end 16 of the arm 12 includes an upwardly opening blind bore 40 formed therein in which a threaded pivot shank 42 is threadedly secured and the arm 14 includes a longitudinal slot 44 formed therein. The pivot shank 42 is received upwardly through the slot 44 and a fiber washer 46 is disposed about the pivot shank 42 between the arms 12 and 14, a wing nut type fastener 48 being threaded on the upper end of the pivot shank 42.

The arm 14 includes first and second longitudinal edges 50 and 52 which parallel the slot 44 and the pivot shank 42 and fastener 48 serve to pivotally connect the arms 12 and 14 for a full 360° relative angular displacement.

In addition, the base end 20 of the arm 14 is defined by a circular terminus 53 having 15 equally angularly displaced bores 54 formed therethrough concentric about the adjacent end of the slot 44 and the spacing of the pins 32 from the pivot shank 42 is equal to the spacing of the bore 54 outwardly of the end of the slot 44 extending into the terminus 53. In addition, the spacing between the pins 32 is equal to the spacing between two of the bores 54 having a third bore disposed therebetween. Accordingly, the pins 32 may be received in selected pairs of bores 54 when the pivot shank 42 is disposed in the end of the slot 44 extending into the terminus 53 in order to releasably retain the arms 12 and 14 in 16 predetermined relatively angularly displaced positions spaced 22½° apart. Also, the size of the pins 32 adjacent the pivot shank 42 are disposed in a plane spaced from the center axis of the pivot shank 42 equal to the spacing of the center of the slot 44 from the longitudinal edge 50 of the arm 14. Accordingly, upon downward retraction of the pins 32 from the bores 54 by downward depression of the button, the fastener 48 may be loosened and the arm 12, disposed at 90° relative to the arm 14 in the manner illustrated in solid lines in FIG. 1 of the drawings, may be slid longitudinally of the arm toward the other end of the slot 44 in the manner illustrated in phantom lines in FIG. 1. After the desired positioning of the short arm 12 along the long arm 14 is achieved, the button 36 may be released and the sides of the pins 32 adjacent the pivot shank 42 will abut the edge 50 and maintain the arm 12 in position disposed at right angles to the long arm 14. Thereafter, the fastener 48 may be tightened.

Figures 4, 5, 6, 7:
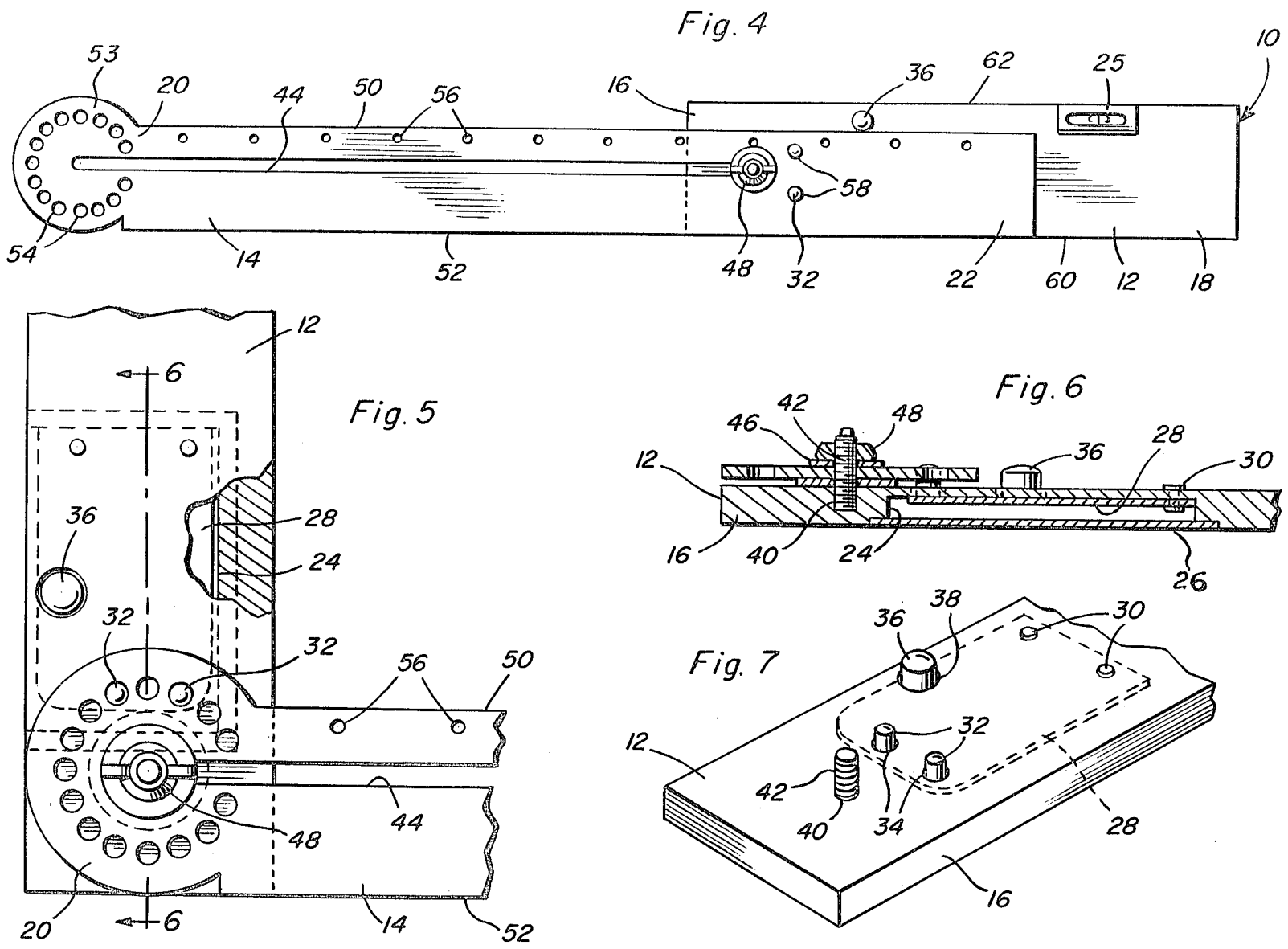
FIG. 4 is a plan view similar to FIG. 3, but illustrating the shorter arm extended relative to the free end of the longer arm.
FIG. 5 is an enlarged, fragmentary, plan view of the juncture between the long and short arms of the square and with portions of the short arm being broken away and illustrated in horizontal section.
FIG. 6 is a fragmentary, vertical, sectional view taken substantially upon the plane indicated by the section line 6—6 of FIG. 5.
FIG. 7 is a fragmentary, perspective view of the base end portion of the short arm of the square.

It is also pointed out that the edge 50 of the arm 14 has a plurality of compass point receiving apertures 56 formed therein and spaced longitudinally therealong. Also, the free end portion 22 of the arm 14 includes a pair of transversely spaced bores 58 of substantially the same size as the bores 54 and in which the pins 32 may be snugly received when the arms 12 and 14 are in the relative positions thereof illustrated in FIG. 4 with the pivot shank 42 disposed in the end of the slot 44 remote from the terminus 53. The pins 32 may thus be utilized in conjunction with the bores 54 in order to secure the arm 12 in position forming an extension of the arm 14. Further, when in this position, the longitudinal edge 60 of the arm 12 forms a continuation of the adjacent end of the longitudinal side edge 52 of the arm 14.

Still further, when the arms 12 and 14 are pivoted to the superposed positions thereof illustrated in FIG. 3 of the drawings, the spacing of the button 36 relative to the arm 12 is such that the button 36 abuts the longitudinal edge 50 of the arm 14 in order to align the longitudinal edge 52 of the arm 14 with the longitudinal edge 62 of the arm 12.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination, elongated first and second arms including corresponding base and free ends, pivot means pivotally connecting said base ends for relative angular displacement of said arms a full 360°, said pivot means and one of said arms including means operative to variably adjustably position said pivot means longitudinally of said one arm toward the free end thereof, said first and second arms including coacting latch means operative to releasably lock said arms in a plurality of predetermined relatively angularly displaced positions when said pivot means is disposed adjacent the base end of said one arm, said latch means also including means operative to releasably lock said arms in 90° relative positions during at least a major portion of the total length of adjustment of said pivot means along said one arm from said base end thereof toward the free end thereof, said pivot means comprising a pivot shank carried by the other arm and a longitudinal slot formed in said one arm through which said shank is received, said latch means including on the base end of said one arm a circular arrangement of a plurality of bores equally spaced from and disposed about the adjacent end of said slot, said slot being of a width substantially equal to the diameter of said bores and equally spaced between a pair of said bores, said latch means including on the other arm a pair of retractable pins supported therefrom receivable in said bores and said slot for maintaining said arms in a plurality of predetermined relatively angularly displaced positions, said one arm including a longitudinal side edge generally paralleling said slot and spaced from the longitudinal center line of said slot a distance equal to the spacing of said pins from the axis of pivotal movement of said arms defined by said pivot means, said pins being engageable with said longitudinal side edge when said arms are disposed at 90° relative to each other and said pivot means is spaced along said slot toward the free end of said one arm in order to lock said arms in right angularly disposed positions.

2. The combination of claim 1 wherein said latch means also includes means operative to releasably retain said arms in 180° positions when said pivot means is disposed in the end of said slot remote from said base end of said one arm.

3. The combination of claim 1 wherein said coacting latch means, when said pivot means is disposed adjacent said base end of said one arm, said bores are arranged to retain said arms in 16 different relatively angularly displaced positions equally angularly displaced 22½° apart.

4. In combination, elongated first and second arms including corresponding base and free ends, pivot means pivotally connecting said base ends for relative angular displacement of said arms a full 360°, said pivot means and one of said arms including means operative to variably adjustably position said pivot means longitudinally of said one arm toward the free end thereof, said first and second arms including coacting latch means operative to releasably lock said arms in a plurality of predetermined relatively angularly displaced position when said pivot means is disposed adjacent the base end of said one arm, said latch means also including means operative to releasably lock said arms in 90° relative positions during at least a major portion of the total length of adjustment of said pivot means along said one arm from said base end thereof toward the free end thereof, said coacting latch means, when said pivot means is disposed adjacent said base end of said one arm including means operative to retain said arms in 16 different relatively angularly displaced positions equally angularly displaced 22½° apart, said pivot means comprising a pivot shank carried by the other arm and a longitudinal slot formed in said one arm through which said shank is received, said base end of said one arm including a circular arrangement of 15 bores equally spaced from and disposed about the adjacent end of said slot with said bores angularly displaced apart 22½° about said corresponding end of said slot, said slot being of a width substantially equal to the diameter of said bores and equally spaced between a pair of said bores, the other arm including a pair of retractable pins supported therefrom receivable in said bores and said slot for maintaining said arms in 16 predetermined relatively angularly displaced positions, said one arm including a longitudinal side edge generally paralleling said slot and spaced from the longitudinal center line of said slot a distance equal to the spacing of said pins from the axis of pivotal movement of said arms defined by said pivot means, said pins being engageable with said longitudinal side edge when said arms are disposed at 90° relative to each other and said pivot means is spaced along said slot toward the free end of said one arm in order to lock said arms in right angularly disposed positions.

5. The combination of claim 4 wherein said latch means also includes means operative to releasably retain said arms in 180° positions when said pivot means is disposed in the end of said slot remote from said base end of said one arm.

6. The combination of claim 5 wherein the free end of the other arm includes longitudinally extending spirit level means.

7. The combination of claim 6 wherein the free end of the other arm includes permanent magnet means supported therefrom.

* * * * *